US006357211B1

(12) United States Patent
Flesch

(10) Patent No.: US 6,357,211 B1
(45) Date of Patent: Mar. 19, 2002

(54) CUTTER ACTIVATING MACHINE FOR PACKAGING APPARATUS

(75) Inventor: Keith E. Flesch, Ossian, IN (US)

(73) Assignee: Aviso Packaging, LLC, Carmel, IN (US)

( * ) Notice: Subject to any disclaimer, the term of this patent is extended or adjusted under 35 U.S.C. 154(b) by 0 days.

(21) Appl. No.: 09/550,426

(22) Filed: Apr. 17, 2000

(51) Int. Cl.[7] ..... B65B 51/24

(52) U.S. Cl. ..... 53/477; 53/374.5; 53/459; 53/550

(58) Field of Search ..... 53/374.5, 450, 53/455, 459, 477, 479, 550, 562, 567, 568

(56) References Cited

U.S. PATENT DOCUMENTS

| | | | | | |
|---|---|---|---|---|---|
| 2,976,657 | A | * | 3/1961 | Cloud | 53/75 |
| 3,805,485 | A | | 4/1974 | Swope | 53/182 |
| 3,866,394 | A | * | 2/1975 | Masai | 53/183 |
| 3,943,683 | A | * | 3/1976 | Kovacs et al. | 53/51 |
| 3,991,640 | A | | 11/1976 | Schlueter | 83/341 |
| 4,305,240 | A | * | 12/1981 | Grevich et al. | 53/373 |
| 4,506,494 | A | | 3/1985 | Shimoyama et al. | 53/551 |
| 4,553,368 | A | | 11/1985 | Ziller | 53/51 |
| 4,704,843 | A | | 11/1987 | Owen et al. | 53/450 |
| 4,840,009 | A | | 6/1989 | Rentmeester et al. | 53/373 |
| 4,881,360 | A | | 11/1989 | Konzal et al. | 53/439 |
| 4,909,016 | A | | 3/1990 | Rentmeester et al. | 53/373 |
| 4,949,846 | A | | 8/1990 | Lakey | 206/484 |
| 4,999,974 | A | | 3/1991 | Kovacs et al. | 53/434 |
| 5,279,098 | A | * | 1/1994 | Fukuda | 53/451 |
| 5,865,015 | A | | 2/1999 | Kume et al. | 53/552 |
| 5,894,709 | A | | 4/1999 | Fosshage | 53/450 |

OTHER PUBLICATIONS

Product brochure, "Horizontal Form/Fill/Seal Machine HAYSSEN® RT 1800," Hayssen, Inc., Duncan, SC.

Selected pages from "6–12 Manual," dated Aug. 1961, for machine now available from Curwood, Inc.

Product brochure, "6–18 Bacon Packaging Machine," Curwood, Inc., New London, WI.

Product brochure, "FL–120 Flexible Packaging Machine," Curwood, Inc., New London, WI.

Selected pages from "6–14BC/YBC Manual," dated Apr. 1971, for machine now available from Curwood, Inc., as FL–120.

Product brochure, "220R Semi–rigid Packaging Machine," Curwood, Inc., New London, WI.

(List continued on next page.)

*Primary Examiner*—Peter Vo
*Assistant Examiner*—Hemant M. Desai
(74) *Attorney, Agent, or Firm*—Baker & Daniels

(57) ABSTRACT

A machine for activating cutting members included in sealing dies carried by a rotating wheel to cause the cutting members to sever a tube of material held within the sealing dies. The machine includes a striker assembly and an actuator. The striker assembly includes a base and a striker element movable relative to the base between first and second location. The actuator is connected to the base to move the striker assembly between first and second positions. When the striker assembly is moved from the first position to the second position, the striker element is moved into operative engagement with a moving sealing die being carried by the rotating wheel to cause the cutting member of the engaged sealing die to shift from a retracted position to a cutting position to sever the tube. While in operative engagement with the moving sealing die, the striker element moves with the sealing die and relative to the base from the first location to the second location in a direction generally tangential to the wheel. A method of producing discrete packaged articles is also disclosed.

16 Claims, 6 Drawing Sheets

OTHER PUBLICATIONS

Product brochure, "MH Sureflow 900E Series Thermoform, Fill and Seal Packaging Machine Systems," Mahaffy & Harder Engineering Company, Totowa, NJ.

Product brochure, "MH Sureflow Model 730 Thermoform, Fill and Seal Packaging Machine System," Mahaffy & Harder Engineering Company, Totowa, NJ.

Selected sections of product brochure of FMC Wrappers, FMC Corp., Green Bay, WI.

Product brochure, "Hayssen Ultima™, A Breakthrough in Technology Creating the Ultimate in Vertical Form, Fill and Seal Machinery," Hayssen Manufacturing Co., Clinton, MS.

Product brochure, "Wright Mon–O–Bag® with Volumetric Filler," Wright Machinery Company, Inc., Durham, NC.

Product brochure, "Mon–O–Bag® Modular Net Weigher System," Wright Machinery Company, Inc., Durham, NC.

Product brochure, "Design Simplicity for High Speed Production," Chub Machine, Davenport, IA.

Product brochure, "Ropak in Motion," Ropak Manufacturing Co., Inc., Decatur, AL.

Product brochure, "Flat Bottom Adds Stand–up to Pouch," reprinted from Package Engineering, May 1968 Issue, Mira–Pak, Inc., Houston, TX.

Product brochure, "Woodman's Clipper Thinline NW–713 S Mark II," The Woodman Company, Inc., Decatur, GA.

Product brochure, "Woodman's Clipper Model VT–510," The Woodman Company, Inc., Decatur, GA.

Product brochure, "Transwrap Hustler Form–Fill–Seal Machine," Package Machinery Company, Oakland, CA.

* cited by examiner

CUTTER ACTIVATING MACHINE FOR PACKAGING APPARATUS

FIELD OF THE INVENTION

The present invention relates to packaging apparatuses, and, in particular, to a machine used to cut a tube of flexible material within which an article is packaged.

BACKGROUND OF THE INVENTION

A variety of differently configured apparatuses are currently utilized within the packaging industry. One well known packaging apparatus which is widely used, particularly in the cheese packaging industry, is a horizontal form, fill and seal type apparatus previously manufactured by Hayssen Manufacturing Company, which apparatus is similar in pertinent part to machines now being made by Hayssen, Inc. This apparatus forms a tube from a web of heat-sealable material, fills the horizontally moving tube with product spaced along the tube length, and then seals and severs the tube both in front of and behind the product as the tube enwrapped product is continuously moved along a rotary turret or die wheel.

In the past, tube severing has been accomplished with a roller that contacts a cutting element of the sealing unit that holds the tube. The roller is positioned proximate the bottom or underside of the rotary die wheel, and is mounted with its axle arranged parallel to the axis of rotation of the die wheel. As each sealing unit that clamps the tube between products continuously travels in a circular path with the die wheel on which it is carried, the roller engages the cutting element of that sealing unit so as to move the cutting element radially to sever the web between separate, successive products.

While useful, packaging apparatuses of this type are not without their shortcomings. Specifically, due at least in part to the fact that the web is severed only after it has been sealed by the sealing units carried by the rotating wheel, the web material has previously been of critical importance. The web material nearly required by this type of packaging apparatus is a three-ply lamination, such as a designer film product known as Curpolene® film available from Curwood, Inc. of New London, Wis.. Other web materials have not been well suited for use with such packaging apparatuses because such web materials are not reliably severed by the prior art roller since the heated web reaching the roller is simply too flexible for the roller-actuated cutting member. Consequently, while other web materials may provide properties which are acceptable from a sealing perspective, such materials have not been sufficiently severable within such packaging apparatuses and therefore have not been widely embraced by the industry.

Thus, it would be desirable to overcome this and other shortcomings of the prior art.

SUMMARY OF THE INVENTION

The present invention provides a machine for a packaging apparatus which applies an impulse load to cutting members installed in sealing dies that hold a tube of flexible packaging material. The impulse load on the cutting members is sufficient to achieve a quick and clean severing of the tube held within the sealing die, and allows tube materials to be used which normally are not suitable for use when the cutting members are roller actuated. The machine uses a striker element configured to move with the cutting member it is activating during the severing process, and as a result the machine does not interfere with the circular motion of the sealing dies as they are carried on a rotatable die wheel. The present invention can be used to cut tubes which have not been significantly heated during the tube sealing process, and consequently may be installed proximate the location at which the sealing dies first engage the tube wrapped article as the articles move through the packaging apparatus.

One advantage of the present invention is that a cutter activating machine may be provided which can be retrofit onto an existing packaging apparatus.

Another advantage of the present invention is that a cutter activating machine may be provided which is capable of severing different types of article enwrapping materials, thereby allowing packaging apparatuses to be used with different and possibly less expensive types of tube materials.

Still another advantage of the present invention is that a cutter activating machine may be provided which applies an impulse or short-acting load on a cutting member of a sealing unit carried by a continuously rotating wheel without requiring the sealing unit to be stopped or slowed during the application of that load.

Still another advantage of the present invention is that a cutter activating machine may be provided which can sever a tube held within a sealing die before that sealing die has heated the tube significantly during the sealing process.

Yet another advantage of the present invention is that a cutter activating machine may be provided which can sever heavier tubes or packaging materials, including resealable zipper portions of tubes.

DESCRIPTION OF THE FIGURES

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
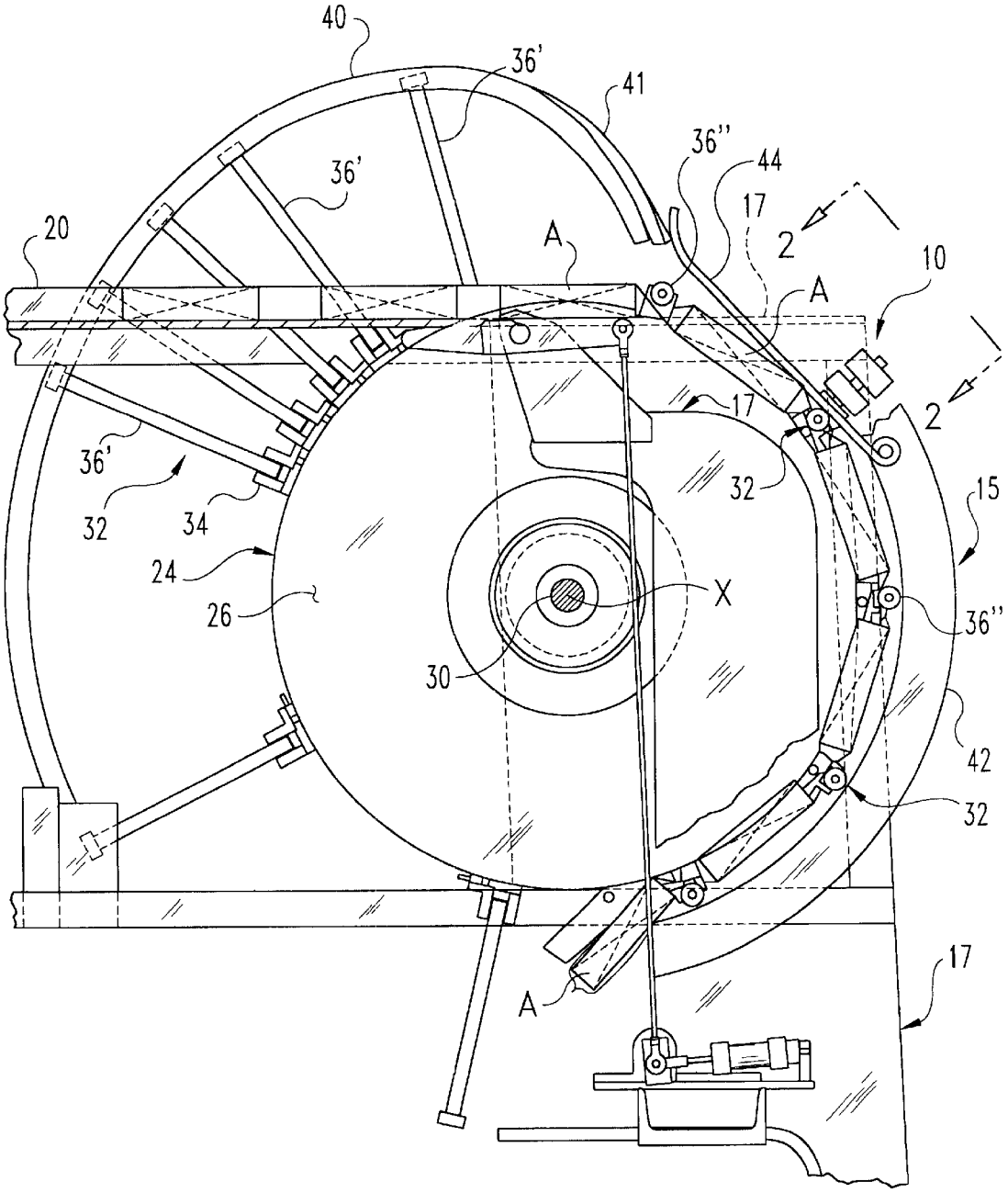
FIG. 1 is a diagrammatic side view of a cutter activating machine of the present invention operatively installed on a partially shown horizontal form, fill and seal packaging apparatus, wherein some parts of the packaging apparatus have been broken away to facilitate illustration and explanation.
Figure 2:
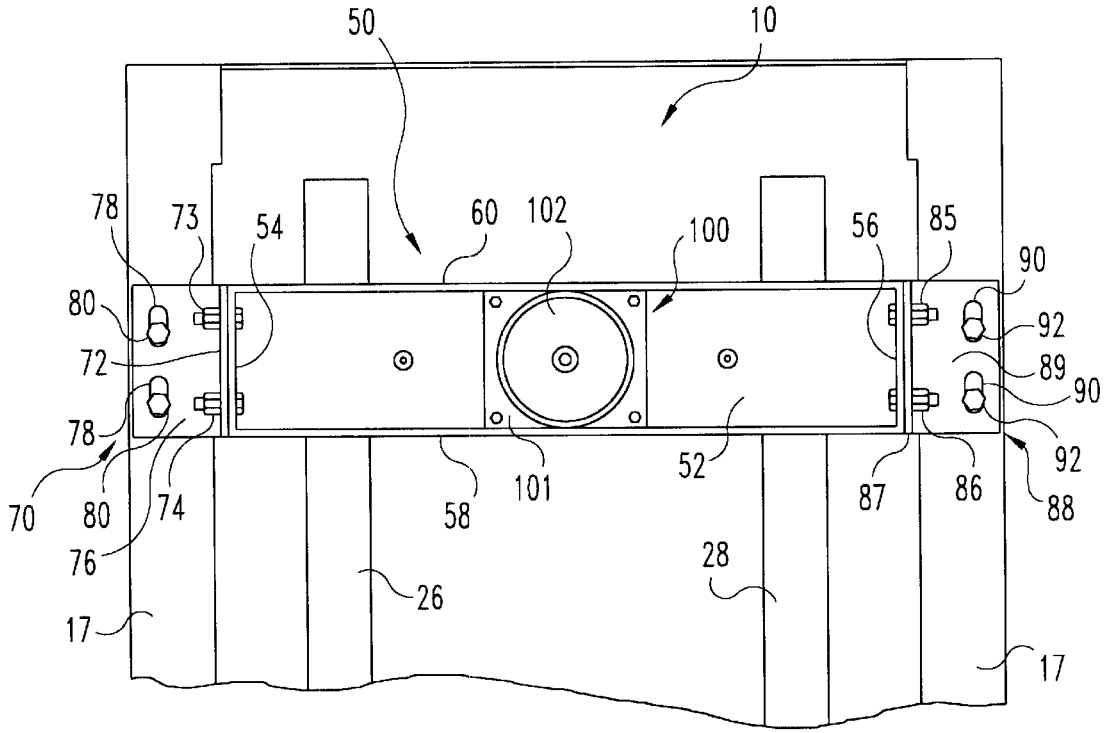
FIG. 2 is a front view, taken along line 2—2 of FIG. 1, further showing the cutter activating machine of the present invention installed to the frame of the partially and abstractly shown packaging apparatus.
Figure 3:
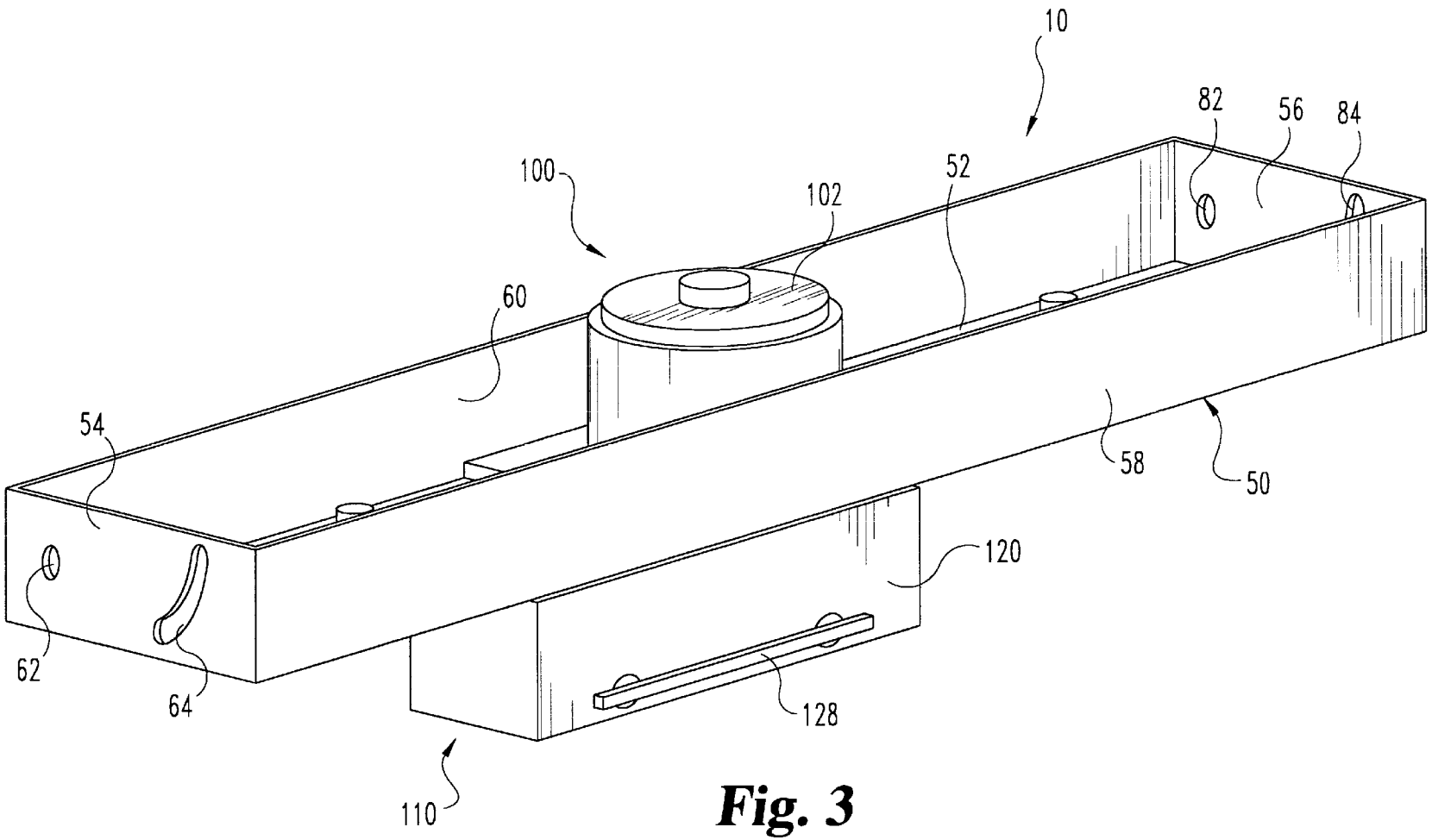
FIG. 3 is a bottom perspective view of the cutter activating machine of FIG. 2 removed from the packaging apparatus, wherein brackets used to mount the machine in FIG. 2 are not shown.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may better utilize the teachings of the invention.

FIG. 1 diagrammatically shows an exemplary form of a cutter activating machine of the present invention, generally designated 10. Machine 10 is shown installed on a sealing means, generally indicated at 15, of a horizontal form, fill and seal apparatus known and widely used in the packaging industry. The packaging apparatus, which is of the type generally described in U.S. Pat. No. 3,943,683 that is hereby incorporated fully herein by reference, forms a tube 20 from a web of heat-sealable flexible film, and fills the formed tube with longitudinally spaced articles A that are moved with tube 20 along a horizontal path to sealing means 15 that is designed to seal tube 20 between successive articles A at package length intervals to form a sealed bag around each article. Machine 10 allows the film used to be not only the typically used designer film, but also most types of coextruded and/or laminated structures.

Sealing means 15 includes a wheel 24 rotatable about a horizontal axis X. Wheel 24 is formed by two circular side plates 26 and 28 that are axially spaced apart a distance somewhat greater than the maximum width of the articles A that can be packaged by the apparatus. Side plates 26 and 28 are secured to a shaft 30 that is journalled to frame 17 of the packaging apparatus. A series of sealing dies or units, each generally indicated at 32, are operatively coupled to side plates 26, 28 at the appropriate time so as to be carried by wheel 24, which is rotatably driven by a motor (not shown) to continuously rotate at a selected velocity during the operation of the packaging apparatus.

Each sealing die 32 includes a base 34 comprising a fixed or lower sealing jaw that spans side plates 26 and 28, and which hingedly carries an upper sealing jaw 36 swingable between an open position, such as shown at 36', and a closed position, such as shown at 36" at which the upper jaw of the sealing die has been moved down to clamp tube 20 against base 34. When an upper sealing jaw 36 is clamped across tube 20 while sealing die 32 is positively coupled to rotating wheel 24, that sealing die 32 serves to pull tube 20 along a curved or semi-circular path through the sealing means 15. More than one sealing die 32 grips tube 20 at any one time, and tube 20 and the articles A enwrapped therein are continuously conveyed in the curved path at substantially the surface speed of the sealing die 32 coupled to wheel 24.

The opened upper jaws 36' of sealing dies 32 are controlled by a guide track 40 with cam closing portion 41 such that the jaws remain open during movement from the point near the bottom of wheel 24 at which articles A are released, to the point near the top of the wheel at which tube 20 is clamped by sealing die 32. Arc-shaped pressure cam 42 is spaced from the outer periphery of wheel 24 and extends around a portion of wheel 24 at which sealing dies 32 clamp the tube 20. Upon exiting pressure cam 42, the upper jaws 36 will open or drop by gravity, and the packaged article A drops free of wheel 24 onto an out-feed conveyor which is not shown. Sealing dies 32 are provided with heating elements that, when the sealing dies are closed to grip the tube as the sealing dies move past pressure cam 42, heat the tube 20 to achieve a tube seal at the back or trail end of one packaged article A and the front or lead end of the next packaged article A within that tube.

In FIG. 1, while cutter activating machine 10 is shown in its operational position, the brackets utilized to mount machine 10 to frame 17 in the preferred embodiment are not shown as such would obstruct the view of other components of the present invention. Although hinged plate 44 used to guide sealing dies 32 appears in FIG. 1 to be between machine 10 and the path of the sealing dies 32 passing radially inwardly thereof, hinged plate 44 is actually closer to the FIG. 1 viewer than the striker assembly of machine 10, and therefore does not interfere with the operation of machine 10.

With additional reference now to FIGS. 2–5, cutter activating machine 10 preferably includes a support frame, generally designated 50, made of a high strength material such as steel. Support frame 50 includes a rectangular base plate 52 from which upwardly extends side plates 54, 56, front plate 58 and back plate 60.

Mounting means are provided to mount support frame 50 to the packaging apparatus frame. In one embodiment, the mounting means includes a first mounting hole 62 and an arcuate mounting slot 64 in support frame side plate 54. L-shaped mounting bracket 70 includes an upstanding flange 72 which is mounted to side plate 54 with fasteners 73 and 74 that extend through holes in the flange and through mounting hole 62 and slot 64, respectively. Fasteners 73 and 74 are shown as bolts with associated nuts, but may be different types of fasteners. The lower flange 76 of mounting bracket 70 includes a pair of slots 78 through which extend fasteners 80, such as bolts with associated securing nuts, to fixedly mount bracket 70 to frame 17 of the packaging apparatus.

Support frame side plate 56 similarly includes mounting hole 82 and arcuate mounting slot 84 which receive fasteners 85, 86 to attach side plate 56 to the upstanding flange 87 of L-shaped mounting bracket 88. Bracket 88 also includes a lower flange 89 with slots 90 that receive fasteners 92 that secure the bracket to the packaging apparatus frame 17.

The arcuate slots 64 and 84 in side plates 54 and 56 allow adjustment of the orientation of support frame 50 during installation. This adjustability allows activating machine 10, and in particular the initial activating stroke of the striker plate to contact sealing dies 32 as described below, to be radially oriented relative to wheel 24. During installation, after brackets 70 and 90 are installed to frame 17, support frame 50 is mounted to the brackets by inserting, but not fully tightening, fasteners 73, 74, 85 and 86. Support frame 50 can then be pivoted about fasteners 73 and 85, such that fasteners 74 and 86 move within arcuate slots 64 and 84, until a proper orientation of the support frame 50 relative to the packaging apparatus is achieved. At the proper support frame orientation, fasteners 73, 74, 85 and 86 are tightened down in order to fix the support frame in that position. The sealing dies 32 are not shown in FIG. 2 for purposes of illustration, but in operation are carried underneath machine 10 as the dies 32 travel with plates 26 and 28 which rotate as part of wheel 24 during the operation of the packaging apparatus.

Fixedly secured to base plate 52 of support frame 50 is an actuator, generally designated 100. The shown securement is with screws at the four comers of the square mounting flange 101 of actuator 100, but the actuator 100 may be secured in alternate manners. Actuator 100 includes a pneumatic cylinder 102 that axially moves an output shaft 104 which projects downwardly through an aperture in base plate 52. The distal end of output shaft 104 is threaded at 106 and screws into a tapped bore provided through top wall 114 of a base 112 of a striker assembly, generally designated 110. The output shaft threads 106 are engaged by locking nut 116 that is tightened up against the underside of top wall 114 in order to prevent shaft 104 from unscrewing from striker base 112 as it reciprocates during operation of machine 10.

Pneumatic cylinder 102 of actuator 100, upon application of high pressure air, moves output shaft 104 from the retracted position shown in the figures so as to move striker assembly 110 radially inwardly relative to wheel 24 toward the passing sealing dies 32. In the shown embodiment, pneumatic cylinder 102 is a 2½ inch diameter air cylinder having a half-inch output shaft stroke, and not shown internal springs of the actuator cause output shaft 104 to return from an axially extended position to its shown retracted position when the supply of air to the pneumatic cylinder 102 is removed.

Pneumatic cylinder 102 is merely one type of actuating element that may be employed within the scope of the invention, as other shaft driving devices including hydraulic cylinders or electric solenoids, as well as other types of devices having non-linear motion output members, may be used in alternate embodiments. The particular actuator is not critical to the invention. The control components and air supply tubing to actuator 100 are not shown in FIGS. 1–5 for purposes of illustration, but may be provided in any suitable fashion such as described below.

Figure 4:
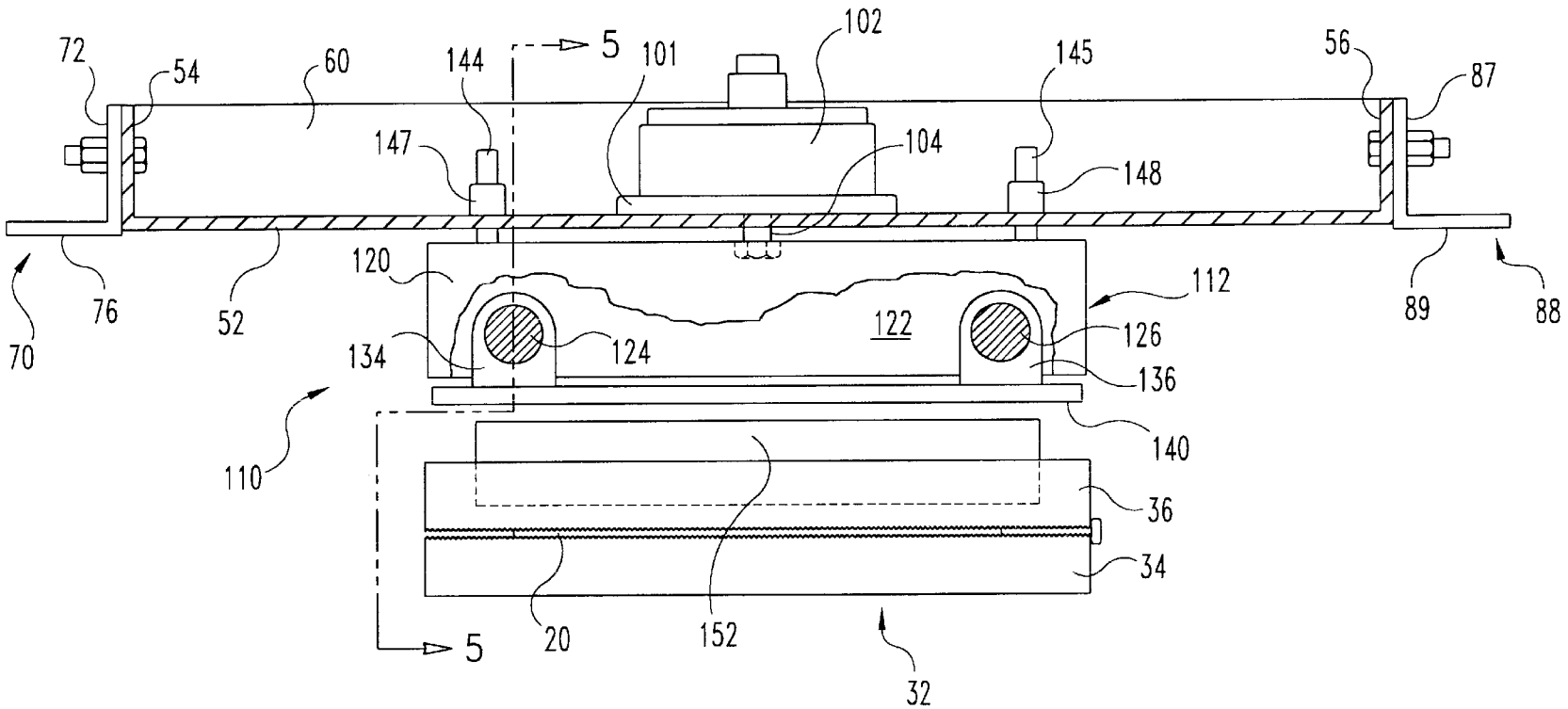
FIG. 4 is a bottom view of the cutter activating machine of FIG. 2, wherein portions have been broken away and removed to reveal the design, and wherein a sealing unit with a cutting element to be activated by the machine is abstractly shown.
Figure 5:
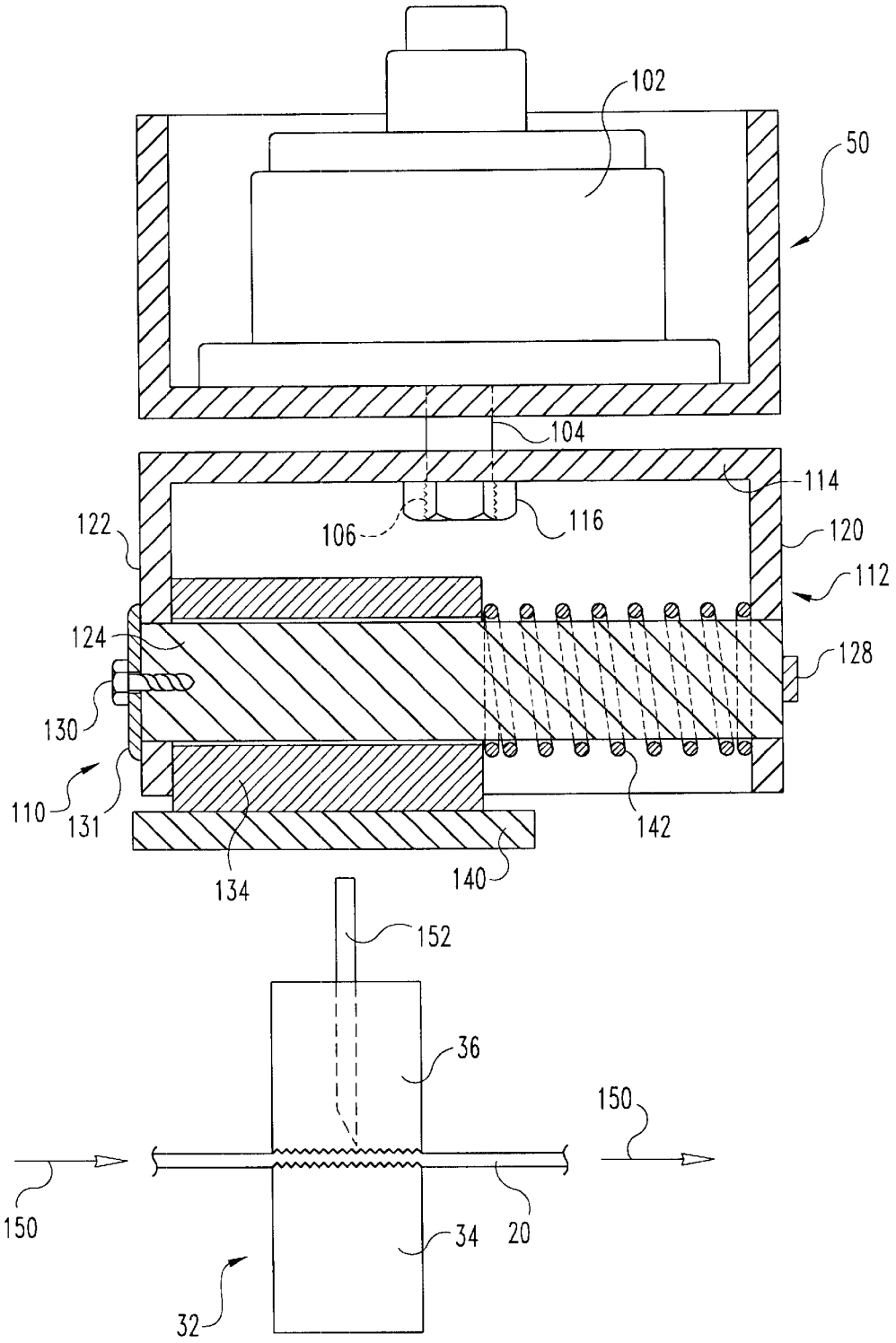
FIG. 5 is a cross-sectional view, taken along line 5—5, of FIG. 4.

With primary reference to FIGS. 4 and 5, striker base 112 is shown in the form of a steel box having an open bottom. Other base shapes may alternatively be employed. Front wall 120 and back wall 122 of striker box 112 include openings in which are press fit the opposite ends of a pair of shafts 124 and 126 that are parallel to each other. Shafts 124 and 126 are made of steel, and an external steel bar 128 is tap-welded to the end face of each of shafts 124 and 126 to prevent the shafts from being withdrawn from front wall 120 into the box interior. As shown in FIG. 5, the opposite ends of shafts 124 and 126 each threadedly receive a screw 130 that extends through a washer 131 which is of a larger size than the shaft diameter so as to abut back wall 122 and thereby prevent shafts 124 and 126 from being withdrawn from back wall 122 into the box interior.

Shafts 124 and 126 form part of two separate ball bushing bearings, and the abstractly shown bearing cages 134, 136 of the bearings are slidable along the axial length of shafts 124, 126, respectively. Bearing cages 134 and 136 are fixedly attached at their lower ends to a steel striker plate 140, such as with a plurality of screws or in any other conventional fashion. The ball bearing bushings permit striker plate 140 to move freely relative to the striker box 112 in a horizontal direction from the perspective of a FIG. 5 viewer, which corresponds to a generally tangential direction relative to wheel 24 when machine 10 is operationally aligned over wheel 24.

Although the shown ball bushing bearings are preferred due to their ability to achieve suitable tangential motion of the striker plate even when large radial forces are exerted on the bearing cages as the striker plate contacts the passing sealing die, other bearing assemblies which facilitate relative motion between the striker box and the striker plate may be employed within the scope of the invention.

Furthermore, while shown as a single plate which is preferably at least as wide as the tube 20 being severed, striker element 140 may be differently configured as long as it cooperates with the sealing die so as to provide a suitable moving force on the cutter.

In the particular embodiment shown in FIG. 5, a helical compression spring 142 is mounted around shaft 124. Spring 142 abuts bearing cage 134 and the inward face of box front wall 120. A similar (but not shown) spring is mounted around shaft 126 between bearing cage 136 and front wall 120. Neither spring is shown in FIG. 4 to facilitate illustration. When compressed during operation as striker plate 140 contacts and moves with a passing sealing die 32 such that plate 140 and the bearing cages move to the right in FIG. 5, springs 142 serve to return bearing cages 134 and 136 to the neutral or home position shown in FIG. 5 against wall 122 when the plate 140 is radially retracted from contact with the die 32. In alternate embodiments, a biasing member could be provided in the form of a compression spring between front wall 120 and an upstanding ear provided on the top surface of striker plate 140, or an extension spring mounted around the bearing shaft and connected to the bearing cage and back wall 122. In addition, the home position of striker plate 140 can correspond to the bearing cages being positioned along the bearing shafts in spaced apart relationship with each of walls 120 and 122, with springs on both axial sides of each bearing cage to properly locate the cages at that position.

To guide vertical motion of striker assembly 110 relative to actuator 100 and prevent striker assembly rotation, a pair of shafts 144 and 145 are fixedly secured and upwardly extend from top wall 114 of striker box 112. Shafts 144 and 145 insert through and vertically slide within low friction bearings 147, 148 mounted over holes in support frame base plate 52.

As shown in FIGS. 4 and 5, when actuator output shaft 104 and therefore striker assembly 110 is in a retracted position, striker plate 140 is spaced above a diagrammatically shown sealing die 32 that passes thereunder as the die is carried by wheel 24 in a circular path in the direction of arrows 150. As is conventional, each sealing die 32 includes a tube cutting member 152, such as a serrated blade, that is oriented along the length of die 32 and which extends at least as long as the width of tube 20 captured between upper jaw 36 and lower jaw 34. In FIGS. 4 and 5, cutting member 152 is abstractly shown as a rectangular knife that extends above the top edge of die upper jaw 36. Cutting member 152 moves down from the perspective of a FIG. 4 or 5 viewer when striker plate 140 moves downward into contact with the cutter, and cutting member 152 moves up under the returning force of not shown springs when striker plate 140 is retracted upward. In typical applications, the cutting member will reside and slide within a slot in die upper jaw 36 and will be connected to upstanding collars that are engageable by striker plate 140, which collars both slide on shafts mounted to the top of upper jaw 36 and are spring-loaded to an upward, or knife retracting, position.

The structure of cutter activating machine 10 will be further understood in view of the following explanation of its operation. When tube 20 with articles A therein are input into sealing means 15 at the top of wheel 24 at a continuous and high rate of speed, such as about 1,200 feet per minute, the sealing dies 32 clamp tube 20 and are coupled to wheel 24 so as to move along a circular path. As it moves around the path, each sealing unit 32 passes underneath, in a radial direction, activating machine 10. As a sealing die passes under striker plate 140, pneumatic cylinder 102 fires to drive output shaft 104 radially inwardly, which in turn moves striker assembly 110 such that striker plate 140 contacts the passing sealing die. When the striker plate 140 contacts the sealing die 32, it applies a load to cutting member 152 which moves member 152 radially inwardly to sever the held tube 20. During the application of this load, sealing die 32 continues along its circular path, and striker plate 140 moves with sealing die 132 and relative to striker base 112 due to the bearing assembly between base 112 and striker plate 140.

Because the load is applied so rapidly, preferably lasting within the range of 100 and 200 milliseconds, and more preferably about 200 milliseconds, tube 20 is severed quickly. This quick severing process results in a clean cut for not only a standard tube material, but also some other tube materials typically not used when the cutting members are roller actuated. Further, this quick severing process allows tubes that have not been heated significantly to be severed by the cutting member.

After the application of the impulse load is complete, pneumatic cylinder 102 is deactivated, and internal springs of actuator 100 move output shaft 104, which in turn moves striker assembly 110, radially outwardly. As striker assembly 110 moves radially outwardly, springs 142 cause striker plate 140 to slide relative to striker base 112 back to a neutral position in preparation of operating on the next passing sealing die. After being acted upon by machine 10, each sealing die 32 continues on a circular path, while continuing to seal the tube portions adjacent the now severed tube segment, to a point proximate the base of wheel 24 at which the sealing dies move clear of cam 42 and open so as to allow the packaged article to fall to a not shown conveyor for transport to another location.

Figure 6:
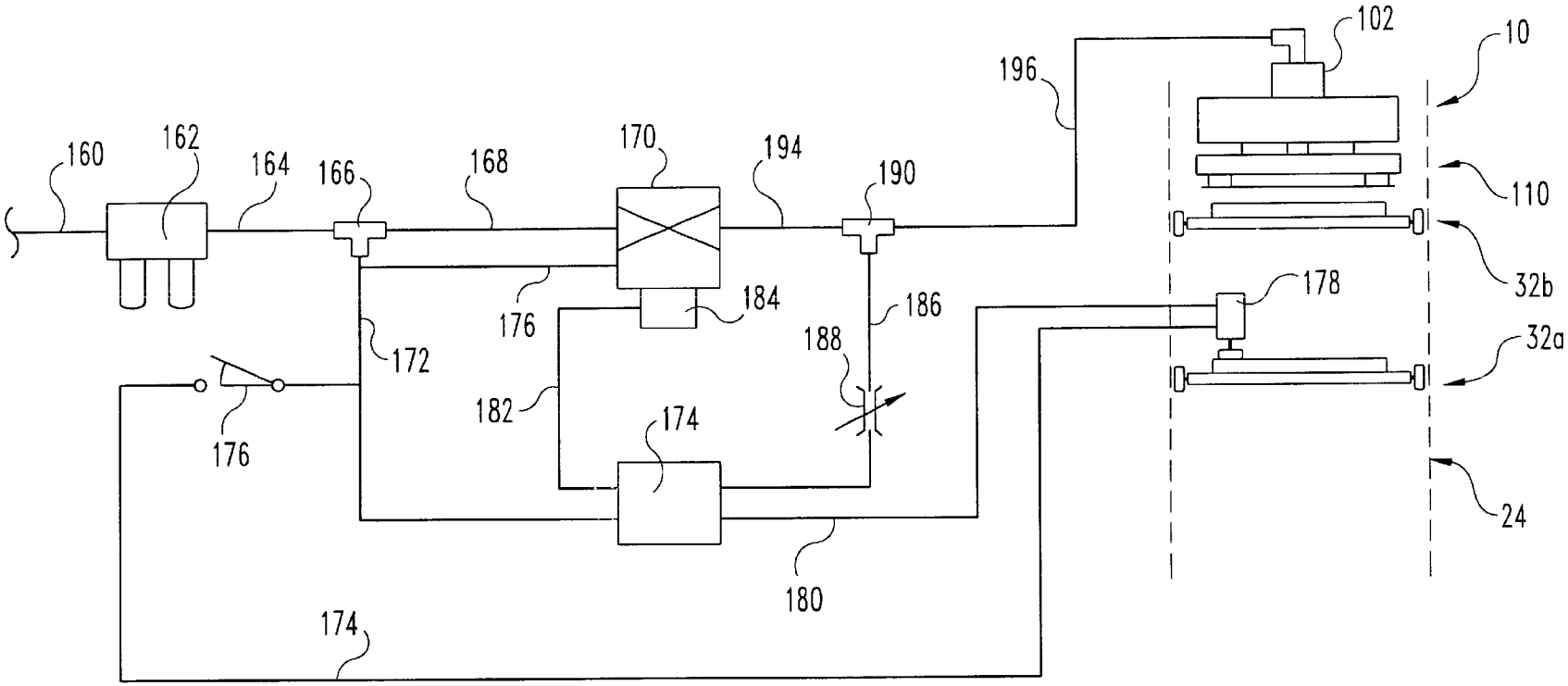
FIG. 6 is a schematic diagram of one control system for the cutter activating machine of FIGS. 1–5.

FIG. 6 shows a schematic diagram of one system for controlling cutter activating machine 10. An air supply is connected by tubing 160 to an air regulator and filter 162 that outputs air into a ⅜ inch tubing 164 at approximately 40 psi. Air supplied through tubing 164 is branched at tee 166 into a ⅜ inch tubing 168 that supplies air to an air pilot three way valve 170, and a 5/32 inch tubing 172 that extends to pneumatic memory relay 174. A 5/32 inch tubing 176 for providing a pilot extends between the pilot of valve 170 and tubing 172. A 5/32 inch tubing 176 provided with a pneumatic on/off switch 176 extends between pneumatic switch 178 and tubing 172.

In this particular embodiment, pneumatic switch 178 is positioned along the rotating wheel 24 so as to be engaged or physically contacted by a passing sealing unit 32*a* that has just previously been acted upon by machine 10 such that its held tube has been severed. Switch 178 can be positioned so as engage different sealing units, including the sealing unit to be acted upon next by machine 10.

A 5/32 inch tubing 180 extends between pneumatic switch 178 and pneumatic memory relay 174. A 5/32 inch tubing 182 connects pneumatic memory relay 174 to a delay timer 184 connected to valve 170 which is adjustable so as to control when pneumatic cylinder 102 of machine 10 is fired such that striker assembly 110 comes down directly on top of the cutter of the passing sealing unit 32*b*. Delay timer 184 naturally will be adjusted when the speed of the packaging machine is changed.

A 5/32 inch tubing 186 with flow control valve 188 extends between tee 190 and pneumatic memory relay 174. Flow control valve 188 controls the rate at which air fed from tee 190 gets back to reset pneumatic memory relay 174, which thereby controls the duration of the actuator operation. Tee 190 is also connected to a ⅜ inch tubing 194 connected to the output of valve 170, and to a ⅜ inch tubing 196 connected to air cylinder 102 of machine 10.

When air is being supplied to valve 170 by regulator 164, to operate the system, the on/off switch 176 is turned to the on position, thereby providing air to pneumatic switch 178. When switch 178 senses by contact the passing sealing die 31*a*, it opens to send an air pulse through tubing 180 to pneumatic memory relay 174, which responsive to that pulse sends a pulse via tubing 182 to delay timer 184. After the appropriate delay, timer 184 causes valve 170 to open to supply high pressure air through tubing 194 and 196 to machine 10, which fires cylinder 102 to cause the cutting member or knife of the passing sealing die 32*b* to be moved to sever the held tube. When enough supplied air passes through flow control valve 188 so as to reset memory relay 174, delay timer 184 and valve 170 operate to close off the supply of air to machine 10, at which time the spring return of the actuator radially retracts the striker assembly 110 in preparation for the next sealing unit.

It will be appreciated that the system of FIG. 6 is suitable for retrofitting in the field existing packaging apparatuses. However, the system of FIG. 6 is intended to be illustrative and not limiting as other systems for operating machine 10 may be employed within the scope of the present invention. For example, the controller of the packaging apparatus could be programmed to properly fire the actuator, which actuator could be an electric solenoid, based on input such as a reading from an electronic eye which senses the sealing die or indicia on the held tube.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. In an apparatus for packaging articles in a tube of flexible material, wherein the articles are longitudinally spaced in the tube, wherein the apparatus includes a wheel and a series of transverse sealing dies carried by the wheel and adapted to transversely seal the tube between successive articles within the tube as the sealing dies are carried around the wheel while holding the tube, the sealing dies each including a cutting member movable between a retracted position and a cutting position for tube severing, the improvement comprising:

a striker assembly including a base and a striker element movable relative to said base between first and second locations;

an actuator connected to said base to move said striker assembly between first and second positions;

wherein movement of said striker assembly from said first position to said second position moves said striker element into operative engagement with a moving sealing die being carried by the wheel to cause the cutting member of the engaged sealing die to shift from the retracted position to the cutting position to sever the tube; and wherein while in operative engagement with the moving sealing die said striker element moves with the sealing die and relative to said base from said first location to said second location.

2. The apparatus of claim 1 wherein said striker element comprises a plate, and wherein said plate is mounted to said base by at least one bearing assembly to facilitate movement of said striker plate relative to said base between said first and second locations.

3. The apparatus of claim 2 wherein said plate comprises a width at least about as large as the transverse dimension of the tube held within the sealing dies.

4. The apparatus of claim 2 wherein said at least one bearing assembly is a ball bushing bearing comprising a shaft and bearing cage axially movable along the shaft length, wherein said shaft is attached to said base, and wherein said plate is attached to said bearing cage.

5. The apparatus of claim 1 wherein said actuator comprises a pneumatic cylinder that operates to move an output shaft from a retracted position to an extended position, and wherein said actuator further comprises a spring for returning said output shaft to the retracted position from the extended position.

6. The apparatus of claim 1 wherein said striker assembly further comprises a biasing member between said base and said striker element to urge said striker element from said second location toward said first location.

7. The apparatus of claim 6 wherein said biasing member comprises a compression spring.

8. The apparatus of claim 1 further comprising an actuator support member to which the actuator is secured, and a pair of mounting brackets attachable to frame portions flanking the wheel and attachable with fasteners to opposite end plates of said actuator support member, wherein each of said opposite end plates comprises a mounting hole and an arcuate mounting slot that receive said fasteners, whereby an angular orientation of said actuator relative to the wheel may be adjusted by changing the positioning of said fasteners along the lengths of said arcuate mounting slots.

9. The apparatus of claim 8 further comprising means for guiding the movement of said striker assembly relative to said actuator, said guiding means comprising a plurality of shafts connected to said base and extending through openings in said actuator support member.

10. An activating machine for cutting members included in sealing dies carried by a rotating wheel, which cutting members are movable between retracted positions and cutting positions for tube severing, which sealing dies hold and transversely seal a tube of flexible material between longitudinally spaced articles within the tube as the sealing dies travel with the wheel, said machine comprising:

a striker assembly including a base and a striker element, said striker element being mounted to said base with at least one bearing assembly that facilitates motion of said striker element relative to said base between first and second locations;

an actuator including an output member selectively movable between first and second positions based on the location of the sealing dies, said output member connected to said striker assembly base such that movement of said output member from said first position to said second position moves said striker assembly relative to the wheel from a first radial position to a second radial position;

wherein movement of said striker assembly from said first radial position to said second radial position moves said striker element into operative engagement with a moving sealing die being carried by the wheel to cause the cutting member of the engaged sealing die to shift from the retracted position to the cutting position to sever the tube; and wherein while in operative engagement with the sealing die said striker element moves with the sealing die and relative to said base from said first location to said second location in a direction generally tangential to the wheel.

11. The activating machine of claim 10 wherein said striker element comprises a plate having a width aligned transverse to the length of the tube extending between the sealing dies, said plate width being at least about as large as the width of the tube held within the sealing dies.

12. The activating machine of claim 10 wherein said at least one bearing assembly comprises a pair of ball bushing bearings, each of said ball bushing bearings comprising a shaft and a bearing cage axially movable along the shaft length, wherein said shafts are parallel and each of said shafts is attached to said base, and wherein said striker element comprises a plate attached to each of said bearing cages.

13. The activating machine of claim 10 wherein said striker assembly further comprises a biasing member between said base and said striker element to urge said striker element from said second location toward said first location.

14. The activating machine of claim 13 wherein said biasing member comprises a coiled spring.

15. The activating machine of claim 10 further comprising means for mounting said actuator to a frame of the wheel to allow adjustability in the angular orientation of said actuator relative to the wheel.

16. The activating machine of claim 10 further comprising means for guiding the movement of said striker assembly relative to said actuator.

* * * * *